US006597095B2

(12) United States Patent
Diven et al.

(10) Patent No.: US 6,597,095 B2
(45) Date of Patent: Jul. 22, 2003

(54) CATHODE RAY TUBE MASK FRAME ASSEMBLY

(75) Inventors: Gary Lee Diven, Lancaster, PA (US); Randall Wayne Martin, East Earl, PA (US); Joseph Arthur Reed, York, PA (US)

(73) Assignee: Thomson Licensing S. A., Boulogne Cedex (FR)

( * ) Notice: Subject to any disclaimer, the term of this patent is extended or adjusted under 35 U.S.C. 154(b) by 0 days.

(21) Appl. No.: 09/988,512

(22) Filed: Nov. 20, 2001

(65) Prior Publication Data

US 2003/0094887 A1 May 22, 2003

(51) Int. Cl.[7] ..... H01J 29/07
(52) U.S. Cl. ..... 313/407; 313/404
(58) Field of Search ..... 313/407, 402, 313/403, 404, 405, 406, 408

(56) References Cited

U.S. PATENT DOCUMENTS 4,599,533 A * 7/1986 Ragland ..... 313/407
4,728,853 A * 3/1988 Sone et al. ..... 313/406
5,003,218 A * 3/1991 Gijrath et al. ..... 313/406
5,072,151 A * 12/1991 Spina ..... 313/407
5,103,132 A * 4/1992 Van Der Bolt et al. ..... 313/402
5,214,349 A * 5/1993 Sakata et al. ..... 313/407
5,644,192 A 7/1997 Ragland, Jr. ..... 313/402
5,898,259 A * 4/1999 Reyal ..... 313/407
6,215,237 B1 * 4/2001 Tsuchida et al. ..... 313/402
6,268,688 B1 * 7/2001 Tani et al. ..... 313/402
2001/0002352 A1 * 5/2001 Mizuta et al. ..... 445/35
2002/0024282 A1 * 2/2002 Tani et al. ..... 313/407

* cited by examiner

*Primary Examiner*—Ashok Patel
(74) *Attorney, Agent, or Firm*—Joseph S. Tripoli; Joseph J. Laks; Carlos M. Herrera

(57) ABSTRACT

The invention relates to a tension mask frame for a CRT having a generally rectangular support frame to which a peripheral portion of a tension mask is attached. The support frame has at least a long side and a short side. One side extends along an outer edge of the mask and protrudes inward toward the outer edge of the mask. The short side is attached to the long side to form a closed corner portion between the long side and short side of the support frame. The closed corner portion is used to suspend the mask within a panel portion of the color cathode ray tube.

4 Claims, 5 Drawing Sheets

CATHODE RAY TUBE MASK FRAME ASSEMBLY

FIELD OF THE INVENTION

This invention generally relates to cathode ray tubes (CRTs), and more particularly, to a shadow mask frame assembly for CRTs that eliminates the use of separate corner brackets for supporting the frame assembly within CRTs.

BACKGROUND OF THE INVENTION

A color cathode ray tube, or CRT, includes an electron gun for forming and directing three electron beams to a screen of the tube. A shadow mask, which may be either a formed mask or a tension mask having strands, is located between the electron gun and the screen. The electron beams emitted from the electron gun pass through apertures in the shadow mask and strike the screen causing the phosphors to emit light, so that an image is displayed on the viewing surface of the faceplate panel.

Present CRTs use steel frames to support the shadow mask within the faceplate panels of the tubes. Typically, such frames incorporate two long sides to which the mask is attached, two short sides perpendicular to the long sides and four corner brackets. The short sides are open at the ends, and a substantially flat corner bracket is used to provide the required strength in each corner. All parts are typically assembled by welding.

Because a plurality of parts and extensive welding is employed to make the frame, the ability to control the initial dimensions of the frame at fabrication, as well as dimensional changes during mask/frame assembly and processing, is extremely difficult. Additionally, dimensional inaccuracies affect the ability to attach springs or clips that support the frame in the proper location and orientation.

It is desirable to develop a mask frame assembly that reduces complexity and material usage of the frame without compromising the strength of the frame. Reducing the number of parts and the associated welding will improve the dimensional control of the frame at fabrication, reduce the propensity for dimensional changes during mask/frame assembly and processing, and reduce cost. Further, facilitating in-situ forming of the clip/spring attachment zone will improve the reliability of the structural detail.

SUMMARY OF THE INVENTION

This invention relates to a CRT having a tension mask frame assembly comprising a substantially rectangular support frame having two long sides, two short side, four corners and a tension mask attached to the two long sides of the support frame. The assembly includes closed ends at each of the corners, wherein the closed ends are contiguous with one of the adjacent sides at respective corners and each of the closed ends has a plurality of walls forming a closed corner portion between the long side and the short side of the support frame and including an angled mounting wall for use in suspending the mask within the color cathode ray tube.

BRIEF DESCRIPTION OF THE DRAWINGS

The invention will now be described by way of example with reference to the accompanying figures in which.

DETAILED DESCRIPTION OF THE PREFERRED EMBODIMENTS

Figure 1:
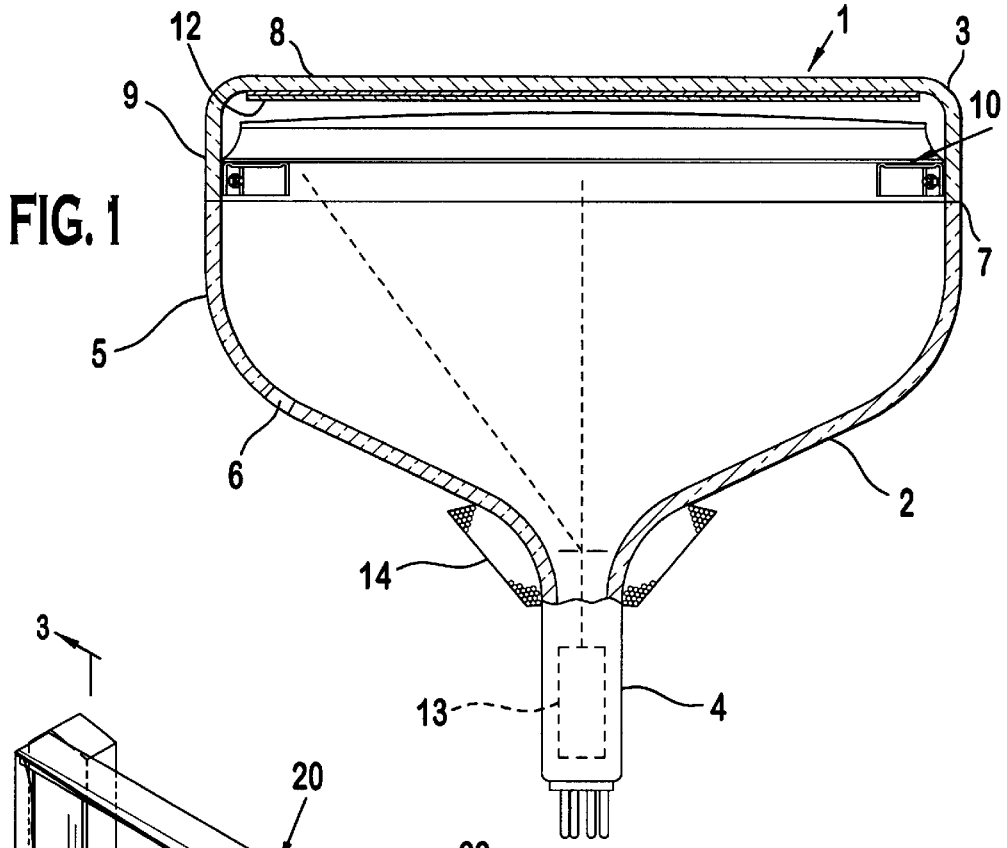
FIG. 1 is a cross-sectional top view of a CRT showing a mask frame assembly.

FIG. 1 shows a cathode ray tube (CRT) 1 having a glass envelope 2 comprising a rectangular faceplate panel 3 and a tubular neck 4 connected by a funnel 5. The funnel 5 has an internal conductive coating (not shown) that extends from an anode button 6 toward the faceplate panel 3 and to the neck 4. The faceplate panel 3 comprises a viewing faceplate 8 and a peripheral flange or sidewall 9, which is sealed to the funnel 5 by a glass frit 7.

A three-color phosphor screen 12 is carried by the inner surface of the faceplate panel 3. The screen 12 is a line screen with the phosphor lines arranged in triads, each of the triads including a phosphor line of each of the three colors. A tension mask support frame assembly 10 is removably mounted in predetermined spaced relation to the screen 12. An electron gun 13 (shown schematically by dashed lines in FIG. 1) is centrally mounted within the neck 4 to generate and direct three inline electron beams, a center beam and two side or outer beams, along convergent paths through the tension mask frame assembly 10 to the screen 12.

The CRT 1 of FIG. 1 is designed to be used with an external magnetic deflection yoke 14 located in the vicinity of the funnel-to-neck junction. When activated, the yoke 14 subjects the three electron beams to magnetic fields which cause the beams to scan horizontally and vertically in a rectangular raster over the screen 12.

Figure 2:
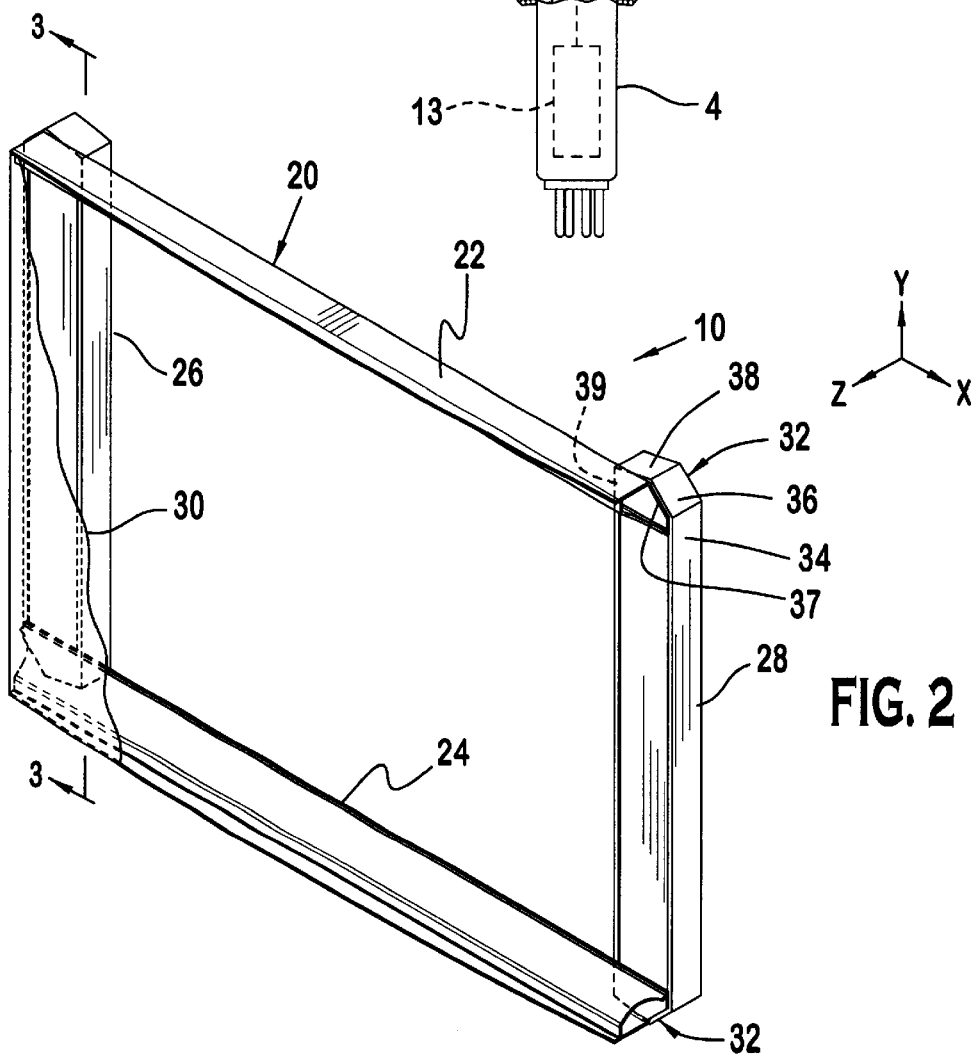
FIG. 2 is a perspective view of a mask frame assembly.
Figure 3:
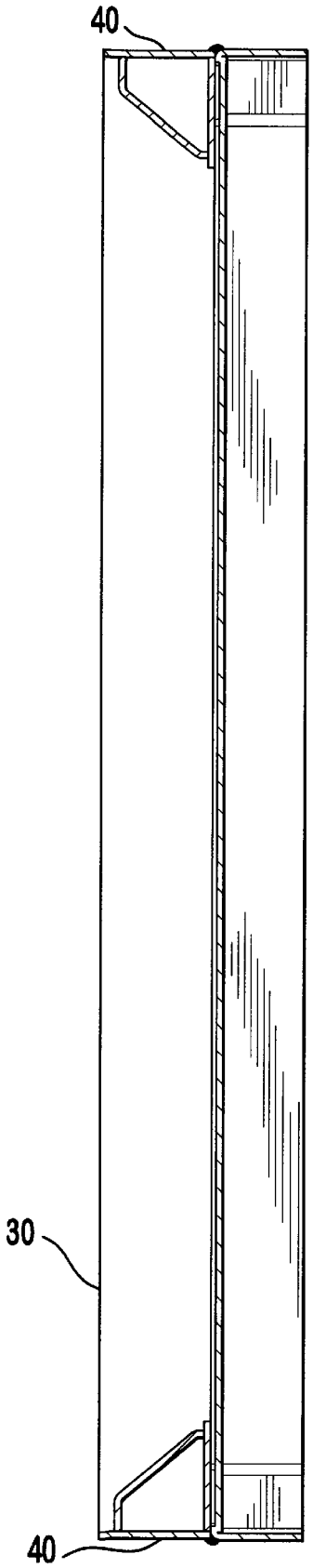
FIG. 3 is cross-sectional view of the mask frame taken along line 3—3 of FIG. 2.
Figure 4:
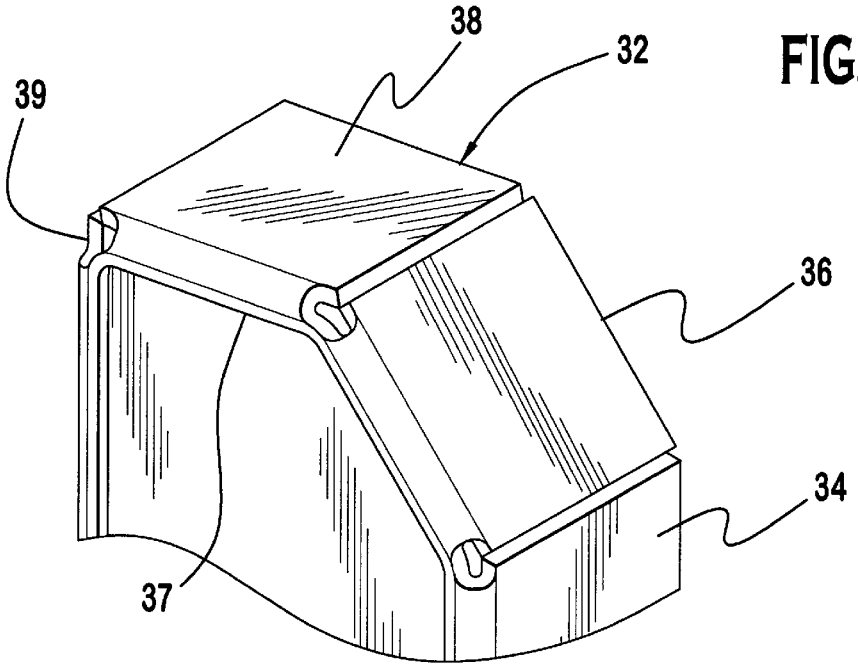
FIG. 4 is an exploded view of a folded closed end of a side rail.
Figure 5:
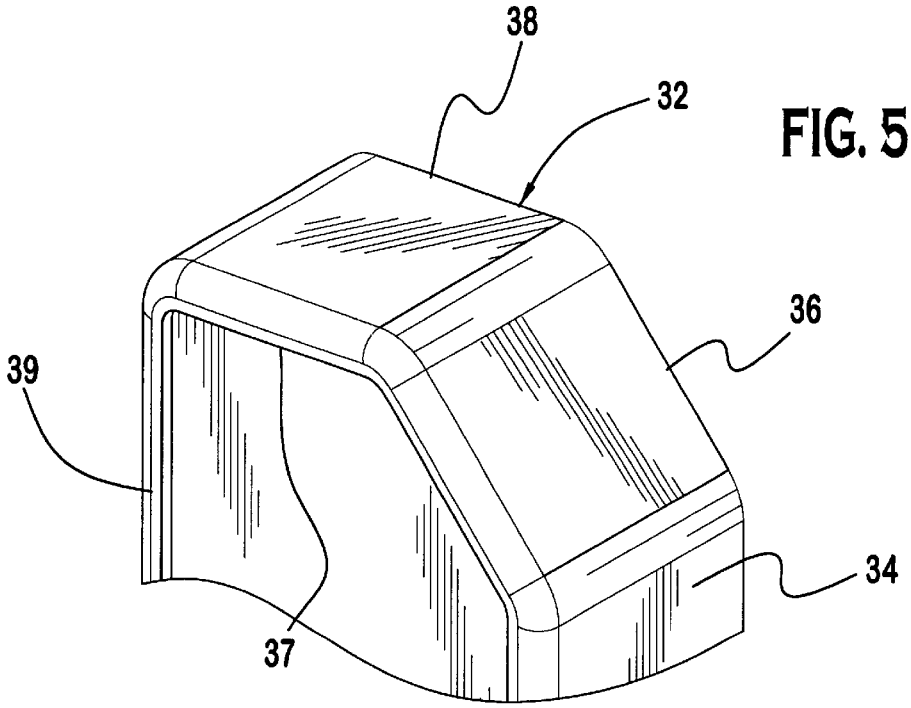
FIG. 5 is an exploded view of a welded closed end of a side rail.
Figure 6:
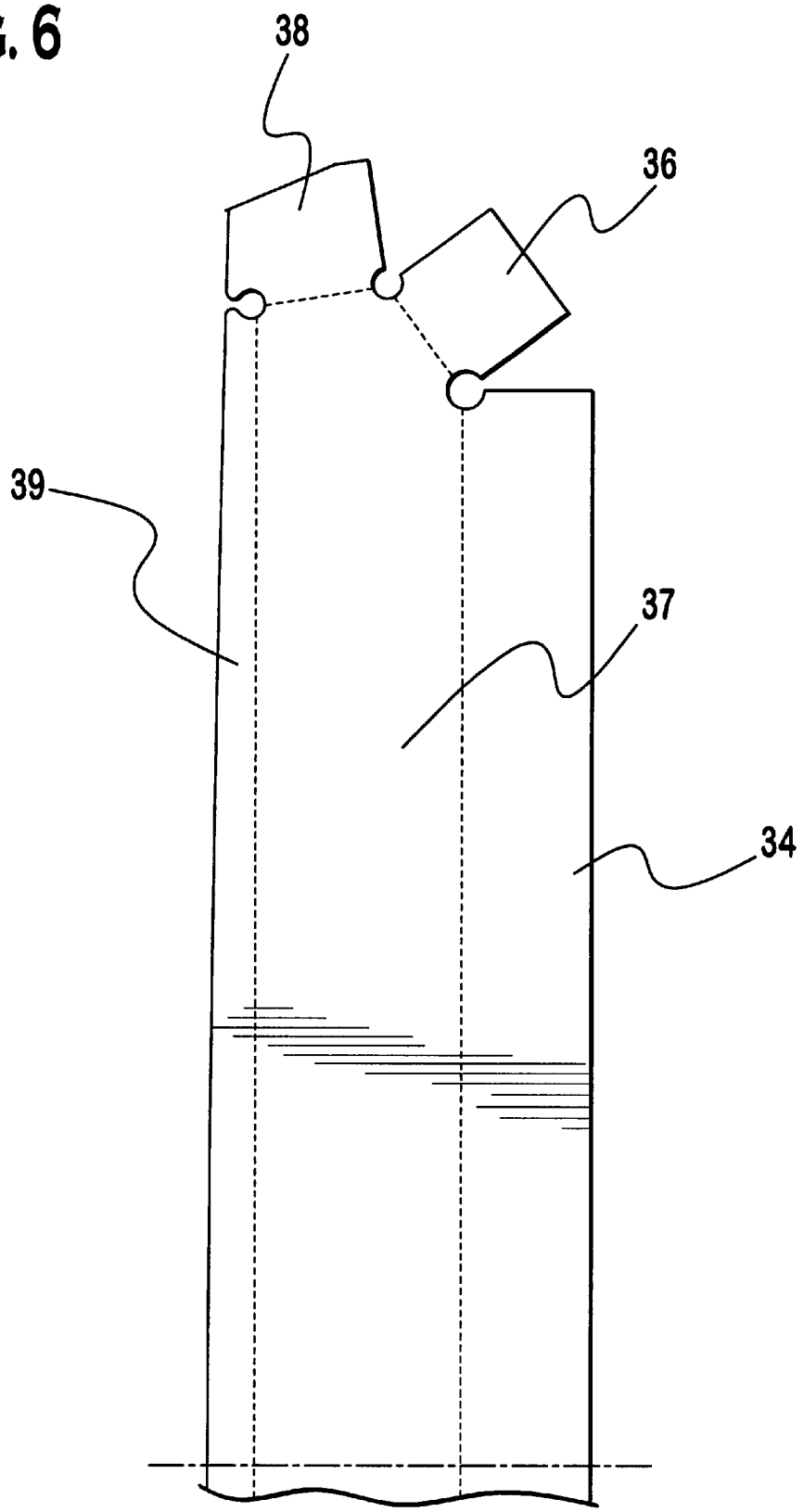
FIG. 6 is a top view of the short sides of the mask support frame flat blank prior to forming the closed end.

The tension mask support frame assembly 10, as shown in FIGS. 1 and 2, has a generally rectangular support frame 20 to which a peripheral portion of a tension mask 30 is attached. The frame 20 includes two long sides 22 and 24 and two short sides 26 and 28 with closed ends 32. The two long sides 22 and 24 of the frame 20 are parallel to a central major axis, X, of the CRT 1; and the two short sides 26, 28 are parallel to a central minor axis, Y, of the CRT 1. The two long sides 22 and 24 and two short sides 26 and 28 preferably form a continuous mask support frame 20. The long sides 22 and 24 can have various cross section shapes which can include rectangles, triangles or L-shapes. Referring now to FIGS. 2–5, the short sides 26 and 28 will be described in greater detail. Each short side 26 and 28 is a one-piece side rail having a closed end 32, as shown in FIGS. 4 and 5. The portions of the short side 26 and 28 forming the closed end 32, can be folded, welded or drawn in such a fashion to replicate the geometry of a corner bracket. FIG. 6 shows the flat blank prior to folding of short sides 26 and 28 of the mask support frame 20, wherein the dotted lines represent the fold lines. Referring to FIGS. 2, 4 and 5, the closed end 32 begins at an outer wall 34 of the short side 28. A clip mounting wall 36 extends from a front surface 37 adjacent to the outer wall 34. The clip mounting wall 36 is oriented at an angle to the outer wail 34. A top wall 38 also extends from the front surface 37 adjacent to the clip mounting wall 36. The top wall 38 is oriented at an angle to the clip mounting wall 36 and approximately perpendicular to the outer wall 34. A closure wall 39 extends also from the front surface 37 and is oriented approximately perpendicular to the top wall 38 and approximately parallel to the outer surface 34. The closure wall 39 extends between the top wall 38 and an outer surface of the long side 22, 24 and is preferably fixed thereto. It should be understood that while each of the walls 34, 36, 38, and 39 are shown as separate sections all bent from the front surface 37 they may be alternatively welded to each other as shown in FIG. 5 wherein the gaps between each wall are filled welds. The short side 26, 28 is attached to the long side 22 and 24 to form a closed corner portion 32 between the long side 22 and 24 and short side 26 and 28 of the support frame 20. The juncture is joined by electric arc welding techniques, laser welding, or other suitable welding techniques. It should be understood that while the closed ends 32 have been described here as extending from the short sides, 26 and 28, the closed ends could alternatively be formed to extend from the long sides 22 and 24, and closed on the short sides 26 and 28 respectively. The tension mask support frame assembly 10 includes an apertured tension mask 30 (shown here diagrammatically as a sheet for simplicity) that contains a plurality of metal strips (not shown) having a multiplicity of elongated slits (not shown) therebetween or a web mask having a plurality of aperutures that parallel the minor axis, Y, of the tube. The tension mask 30 can either be fixed directly to the long sides 22 and 24 or is fixed to a pair of support blade members 40, which are fastened to the frame 20, as best shown in FIG. 3. The support blade members 40 may vary in height from the center of each support blade member 40 longitudinally to the ends thereof to permit the best curvature and tension compliance over the tension mask 30.

Figure 7:
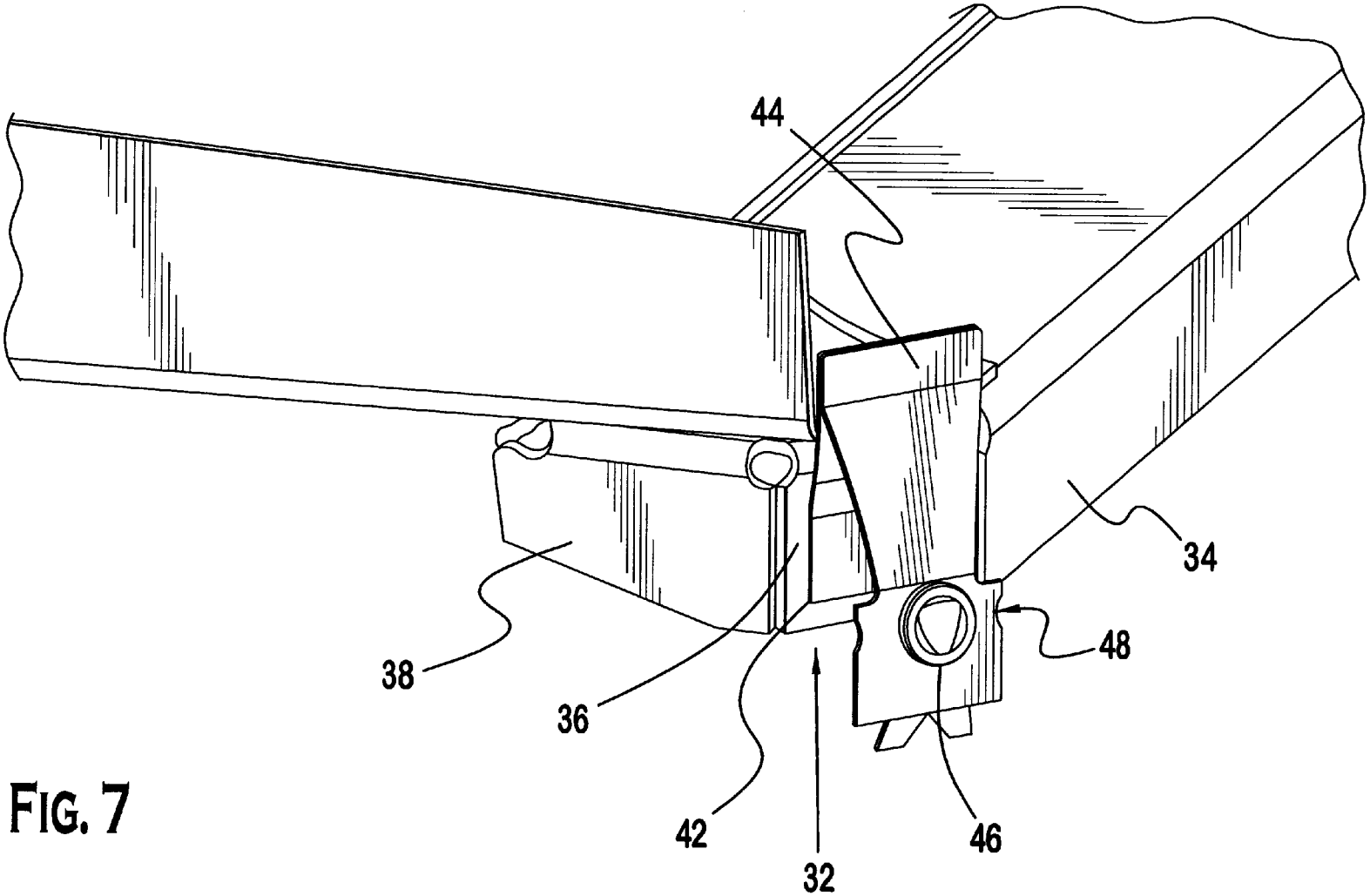
FIG. 7 is an exploded view of the closed end having a clip/spring assembly applied.

In use, as shown in FIG. 7, a clip 42 is welded to an outer surface the clip mounting wall 36 and a spring 44 extends from the clip 42 having mounting features 46 for mounting the support frame 20 to the inside of the CRT 1. As a result, the weld zone between the clip 42 and the spring 44, a clip/spring assembly 48 is formed in its proper location and orientation. Further, the weld zone could be formed and fixed just prior to clip/spring assembly 48 is attached. The closed corner portion 32 is used to suspend the mask 30 within the panel 3 of the color cathode ray tube 1.

In use, it is desirable to have the support frame 20 made of a low expansion material such as from the class of iron-nickel alloys. Examples include INVAR (from Imphy Ugine Precision, F—92070 La Défense Cedex, France), GAMMAPHY (from Imphy Ugine Precision, F—92070 La Défense Cedex, France) and carbide hardened iron-nickel alloys. GAMMAPHY and carbide hardened iron-nickel alloys are preferred over INVAR because they both have greater mechanical strength in terms of being able to provide the required load to a tension mask 30. The carbide hardened iron-nickel alloys are preferred over GAMMAPHY because they do not need to be thermally precipitation hardened, whereas GAMMAPHY does require thermal precipitation hardening.

As the embodiments that incorporate the teachings of the present invention have been shown and described in detail, those skilled in the art can readily devise many other varied embodiments that still incorporate these teachings without departing from the spirit of the invention.

What is claimed is:

1. A cathode ray tube tension mask frame assembly comprising:

a pair of symmetrical long sides, each being formed of a singular structural member;

a pair of symmetrical short sides, each being formed of a singular structural member; the pair of long sides each being joined to the pair of short sides at corners to form a substantially rectangular support frame;

the short sides each having an integral clip mounting wall being bent inward from a front surface and extending from an outer wall of each short side;

a top wall, also extending from the front surface adjacent to the clip mounting wall; and, a closure wall, also extending from the front surface and oriented approximately perpendicular to the top wall and adjacent thereto, to form a closed end at each of the corners.

2. The cathode ray tube tension mask frame of claim 1 wherein each long side has a cross-sectional shape which is rectangular, triangular or L-shaped.

3. The cathode ray tube tension mask frame of claim 1, wherein each long side is attached to each short side by a weld.

4. The cathode ray tube tension mask frame of claim 1, wherein the support frame is an iron-nickel alloy selected from the groups consisting of INVAR, GAMMPHY, and carbide-hardened iron-nickel alloys.

* * * * *